US005551494A

United States Patent [19]

Schneider et al.

[11] Patent Number: 5,551,494

[45] Date of Patent: Sep. 3, 1996

[54] DEVICE FOR MAKING PATCHES, ESPECIALLY OF WOOD, AND FOR PATCHING RESIN GALLS ON PIECES OF WOOD

[75] Inventors: Wilfried Schneider, Bubendorf; Dieter Steiner, Ziefen, both of Switzerland

[73] Assignee: Lamello AG, Hauptstrasse, Switzerland

[21] Appl. No.: 427,923

[22] Filed: Apr. 26, 1995

[30] Foreign Application Priority Data

Apr. 26, 1994 [EP] European Pat. Off. ..... 94810236

[51] Int. Cl.[6] ..... B27C 5/00; B27C 9/00

[52] U.S. Cl. ..... 144/24.16; 144/154; 144/367; 144/2.1; 269/71; 409/165; 409/226

[58] Field of Search ..... 144/2 R, 2 M, 144/3 R, 41, 134 R, 154, 367; 269/3, 6, 71, 157, 160; 409/163, 165, 168, 172, 226, 228

[56] References Cited

U.S. PATENT DOCUMENTS

| | | | |
|---|---|---|---|
| 1,973,757 | 9/1934 | Goss . | |
| 2,077,623 | 4/1937 | Gragg | 144/2 M |
| 2,470,229 | 5/1949 | Anderson . | |
| 4,949,767 | 8/1990 | Murphy | 144/367 |
| 5,104,708 | 4/1992 | Murphy | 144/2 M |

FOREIGN PATENT DOCUMENTS

| | | | |
|---|---|---|---|
| 498192 | 12/1953 | Canada | 144/2 M |
| 661436 | 6/1938 | Germany . | |
| 2125799 | 12/1971 | Germany . | |
| 524440 | 6/1972 | Switzerland . | |

*Primary Examiner*—W. Donald Bray

*Attorney, Agent, or Firm*—Townsend and Townsend and Crew

[57] ABSTRACT

A device for making patches, especially of wood, and for patching resin galls on pieces of wood, comprising a rotatably drivable milling tool, which is rotatably driveable by means of a first driving unit and is held on a supporting frame. Also disposed on the supporting frame is a clamping device, which is rotatable about a rotational axis. A remnant of the workpiece to be patched can be clamped in this clamping device and, by means of rotation about the rotational axis, can be led past the milling tool during which the lateral surface of the remnant is milled. Afterwards the clamping device can be lifted, the remnant being again led past the milling tool, the lateral surface being milled. Afterwards the patch made in this way can be detached. Owing to the small dimensions and the light weight of this device for making patches, it can be used by the craftsman at the work location, it being then possible to make the patch directly from a remnant of the piece of wood to be patched, ensuring that the patch and the piece of wood to be patched correspond in quality.

9 Claims, 6 Drawing Sheets

DEVICE FOR MAKING PATCHES, ESPECIALLY OF WOOD, AND FOR PATCHING RESIN GALLS ON PIECES OF WOOD

BACKGROUND OF THE INVENTION

This invention relates to wood working machines and more particularly to a device for making patches, especially of wood, and for patching resin galls on pieces of wood.

Devices of this kind are known. For example, disclosed in Swiss patent No. 524 440 is a device for producing resin gall patches from a piece of wood. For serial production of patches of this kind using this device, the end of a strip of end-grained wood is led past a groove milling tool which is composed of several milling disks so that the form of the patches can be milled into the end of the strip. The strip is led linearly while the groove milling tool is led along a modelling roller about the end of the strip, the patches being provided with the corresponding radius. The strip of end-grained wood is then led past a cutting off means, by means of which the profile-cut patches can be separated from the strip. Afterwards the production step starts over again, the strip of wood being brought into the starting position and being advanced by an appropriate amount.

Another device for production of patches is disclosed in U.S. Pat. No. 1,973,757. With this device the pieces of wood to be made into patches are given automatically to a clamping device which, by revolving about a rotational axis, leads them past a milling tool. The corresponding contour is thereby milled into the piece of wood. The clamping device releases the shaped piece, to take up a new piece of wood to be shaped. Here, too, serial production of patches is achieved using a stationary device.

The patching of pieces of wood with corresponding patches takes place almost exclusively at the location of the piece of wood to be patched, that is, for example, at places of production, assembly points or building sites. The craftsman is equipped with a hand milling machine for this purpose with which the milling of the piece of wood to be patched is carried out and in which the suitable patch is glued and can be planed afterwards.

Since, as mentioned above, the patches are serially produced at the location of the stationary production device, and since the aforementioned craftsman handles pieces of wood of differing kinds of wood, he carries a whole assortment of prefabricated patches around with him made of differing kinds of wood. He is thereby able to insert into each piece of wood a patch made from the same type of wood.

As is well known, however, pieces of wood of the same type, especially if they come from different trees, can have differences which are conspicuous and which derive, for example, from differences in color and/or differently running grains.

It is desirable that patches inserted in this way are not visible in the corresponding pieces of wood. This invisibility has not been optimally achieved until now, however, because of to the aforementioned differences between the patches and the pieces of wood to be patched, even when they are of the same type of wood. It would be advantageous if the patch could be made from a remnant of the piece of wood to be patched, which is practically infeasible using the known devices.

SUMMARY OF THE INVENTION

Thus the object of the present invention is to provide a device with which a patch of the said type can be produced from a remnant of the piece of wood to be patched, this device having the dimensions and weight of a conventional hand-held appliance.

This object is fulfilled, according to the invention, by a device comprising: a supporting frame, in which a milling tool is held rotatably driveable about a milling axis by a first driving unit; a clamping device disposed on the supporting frame for holding a workpiece to be worked on; means to rotate the clamping device about a rotational axis disposed perpendicular with respect to the milling axis; means to shift the clamping device along the rotational axis from a first position to a second position, in the first position of the clamping device the workpiece being led past the milling tool a first time by means of rotation of the clamping device about the rotational axis, and in the second position of the clamping device it being led a further time past the milling tool by means of rotation of the clamping device about the rotational axis; a cutting off means for separating the patch, provided with its outer form, from the workpiece.

A device is provided thereby which the craftsman can take along with him to his work location, thanks to its minimal dimensions and its light weight.

Preferably foreseen in this device is a rotatably driveable milling tool having in the circumferential area, provided with cutting elements, a contour corresponding to a desired lateral surface of the patch. By leading the remnant past two opposite sides of the milling tool, each of the desired surfaces of the patch to be produced can be correspondingly cut into the remnant.

The clamping device is preferably displaceable along the rotational axis from a first position to a second position, the first position and the second position being determined by means of a stop in each case, one of the stops being adjustable in order to be able to set the thickness of the patch. The displacement of the clamping device is carried out by means of a pivoted lever. Achieved in a simple way by means of this arrangement is that both lateral surfaces of the patch to be produced can be prepared with the same milling tool, the milling tool, which is rotatably driveable, being kept stationary with respect to the device.

Another advantage of the design of the device is that the remnant can be led each time past the milling tool in such a way that the surface to be cut is moved past the milling tool at any given time counter to the direction of rotation of the latter. So that the remnant is led past the milling tool in the correct direction, a lead is provided fixed to the supporting frame, after the milling tool in each case in the direction of movement of the remnant. This lead ensures that the remnant, if the corresponding surface has not yet been cut, cannot be led in the reverse direction and thus must be led in the same direction past the milling tool.

A further advantage of the design of the invention consists in that the cutting off means, comprising a circular saw rotatably driveable by means of a second driving unit, is fixed to a pivoted lever, which is pivotable about a pivot pin fixed to the supporting frame. Thus during the same clamping of the remnant, the patch with the corresponding surface forms can be cut off from the remnant.

BRIEF DESCRIPTION OF THE DRAWINGS

A preferred embodiment of the device according to the invention will now be explained more closely with reference to the accompanying drawing in which.

Figure 1:
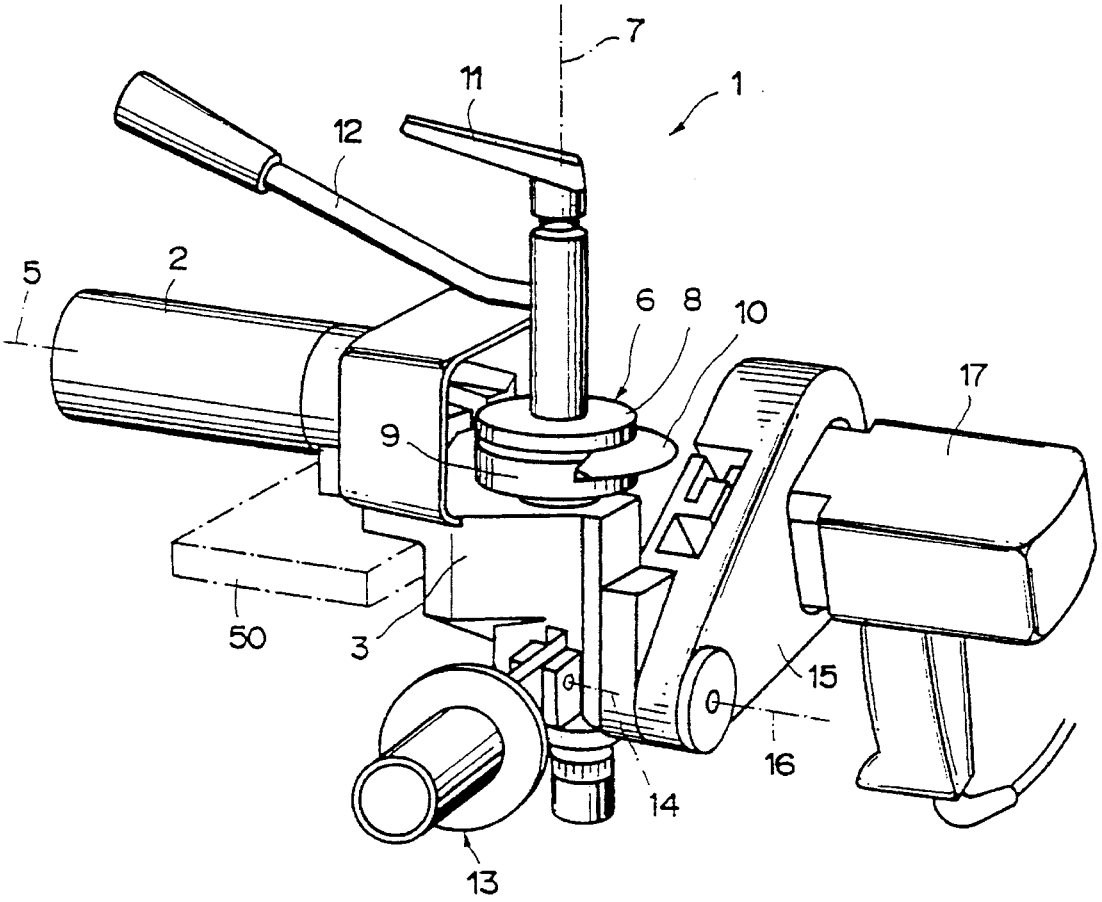
FIG. 1 is a spatial diagram of the device according to the invention.

The construction of the patchmaking device 1 according to the invention can be seen in the spatial diagram of FIG. 1. It comprises a first driving unit 2, which is held on a supporting frame 3. This first driving unit drives a milling tool 4 (FIG. 2) rotatingly about a milling axis 5.

Also held on supporting frame 3 is a clamping device 6, which is rotatable about an axis of rotation 7. In so doing, the axis of rotation 7 is at a right angle to the milling axis 5. The clamping device 6 is equipped with two clamping plates 8 and 9, between which the remnant 10 to be milled can be chucked. Clamping plates 8 and 9 can be clamped against each other by means of a clamping lever 11. Clamping device 6 is rotatable by means of a rotating lever 12, which is firmly connected to the clamping device 6.

Via a pivoted lever 13, which is pivotable about an axis 14 fixed in supporting frame 3, the clamping device 6 can be displaced in the rotational axis direction 7 with respect to supporting frame 3.

Also mounted on supporting frame 3 is a swivelling bow 15, which is pivotable about a pivot pin 16 fixed on supporting frame 3. Mounted on the swivelling bow 15 is a second driving unit 17 by means of which a circular saw 19 (FIG. 9) can be driven rotatingly, and which serves to cut off the patch 19 (FIG. 10) from the remnant 10.

Figure 2:
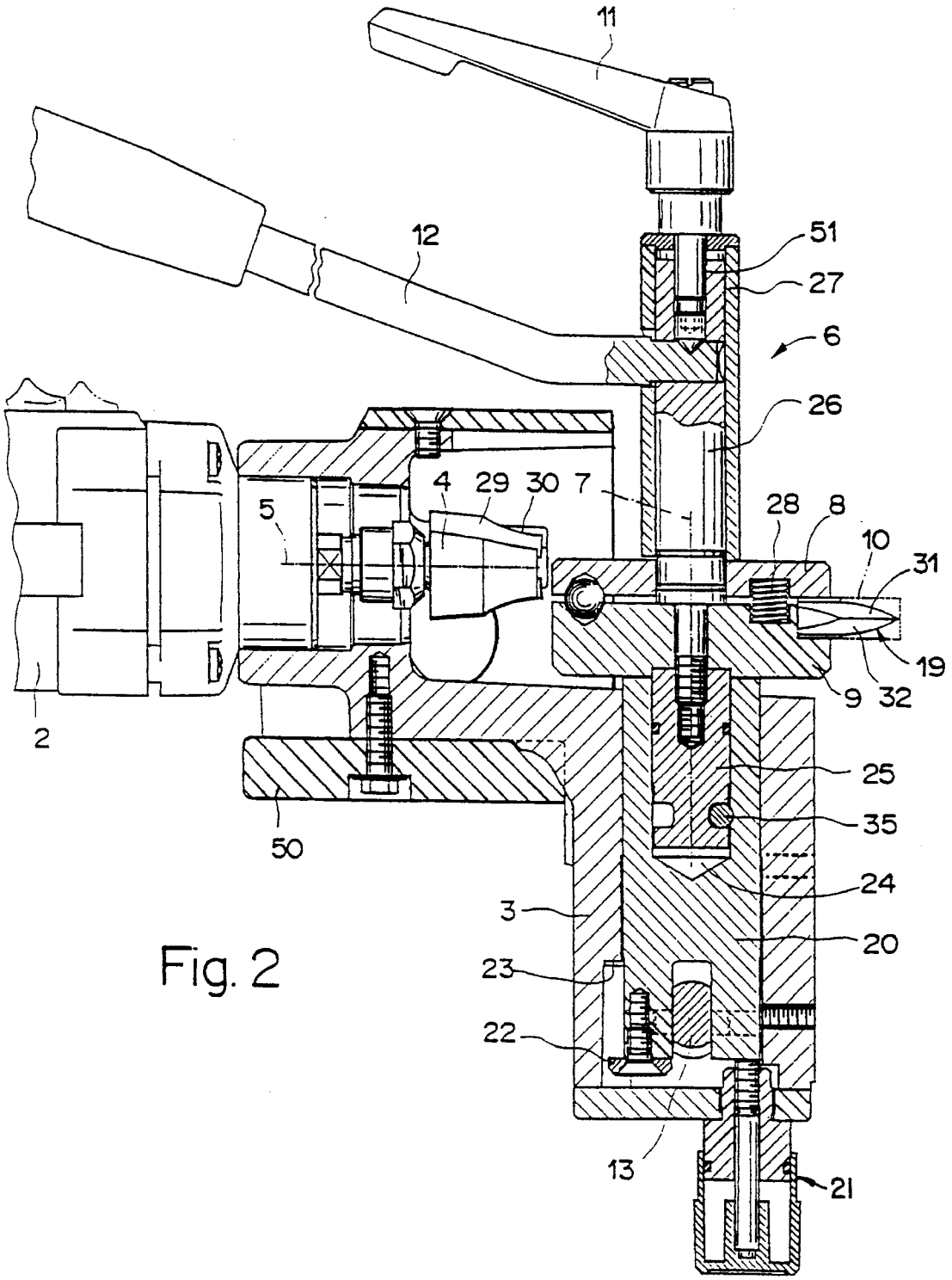
FIG. 2 is a sectional view, the section being in a plane formed by the milling axis and the rotational axis.

As can be seen from FIG. 2, the clamping device 6 has a guiding pin 20, which is secured against rotation by means of pivoted lever 13, but which is displaceable in the supporting frame in the direction of the axis of rotation 7. A first position of the guiding pin 20, corresponding to that shown in FIG. 2, can be determined by means of an adjustable stop 21. A further fixed stop 22, which cooperates with a stopping face 23 of the supporting frame 3, determines the raised second position of the guiding pin 20.

A cylindrical opening 24 is provided coaxially in guiding pin 20. Inserted into this cylindrical opening 24 is a pivot 25, which is fixed in the axial direction by means of pin 35, but which remains pivotable. A clamping plate 9 is mounted on this pivot 25.

Coaxial to pivot 25 and firmly attached thereto is a clamping bolt 26 over which a casing 27 is pushed, which comes to be situated contiguous to clamping plate 8. By turning clamping lever 11, which is screwed into clamping bolt 26 by means of a screw thread 51, the casing 27 can be displaced with respect to the clamping bolt 26, whereby both clamping plates 8 and 9 can be clamped with respect to each other. Upon release of the clamping lever 11, the spring 28 disposed between the two clamping plates 8 and 9 causes the clamping plates 8 and 9 to be moved away from each other. Via the rotating lever 12 the two clamping plates 8 and 9 can rotate about the rotational axis 7, led by the pivot 25 in the guiding pin 20.

Between the two clamping plates 8 and 9, which are provided with a recess, a remnant can be clamped which originally has the shape of a parallelepiped.

To make a patch 19, the clamping device 6 is rotated by the rotating lever 12 about the axis 7 so that a remnant 10 clamped between the two clamping plates 8 and 9 is led past the milling tool 4. This milling tool 4 has cutting elements 29 which are disposed in the circumferential area of the milling tool 4. The cutting elements 29 are provided with a contour 30 which corresponds to the prepared lateral surfaces 31 and 32 of the patch 19 to be attached.

Figure 6:
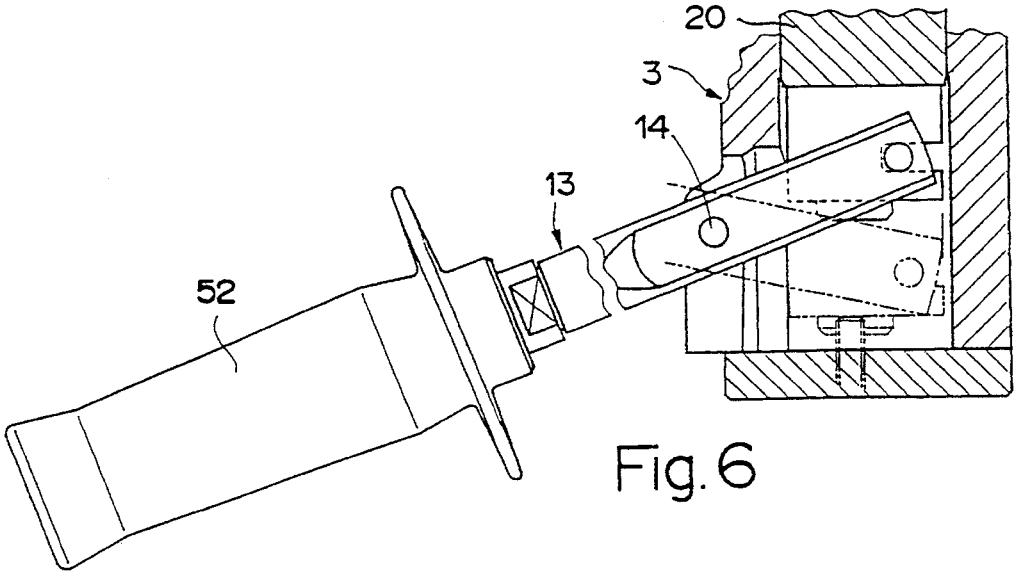
FIG. 6 is a view of the mounting, shown in section, of the pivoted lever for displacement of the clamping device.
Figure 7:
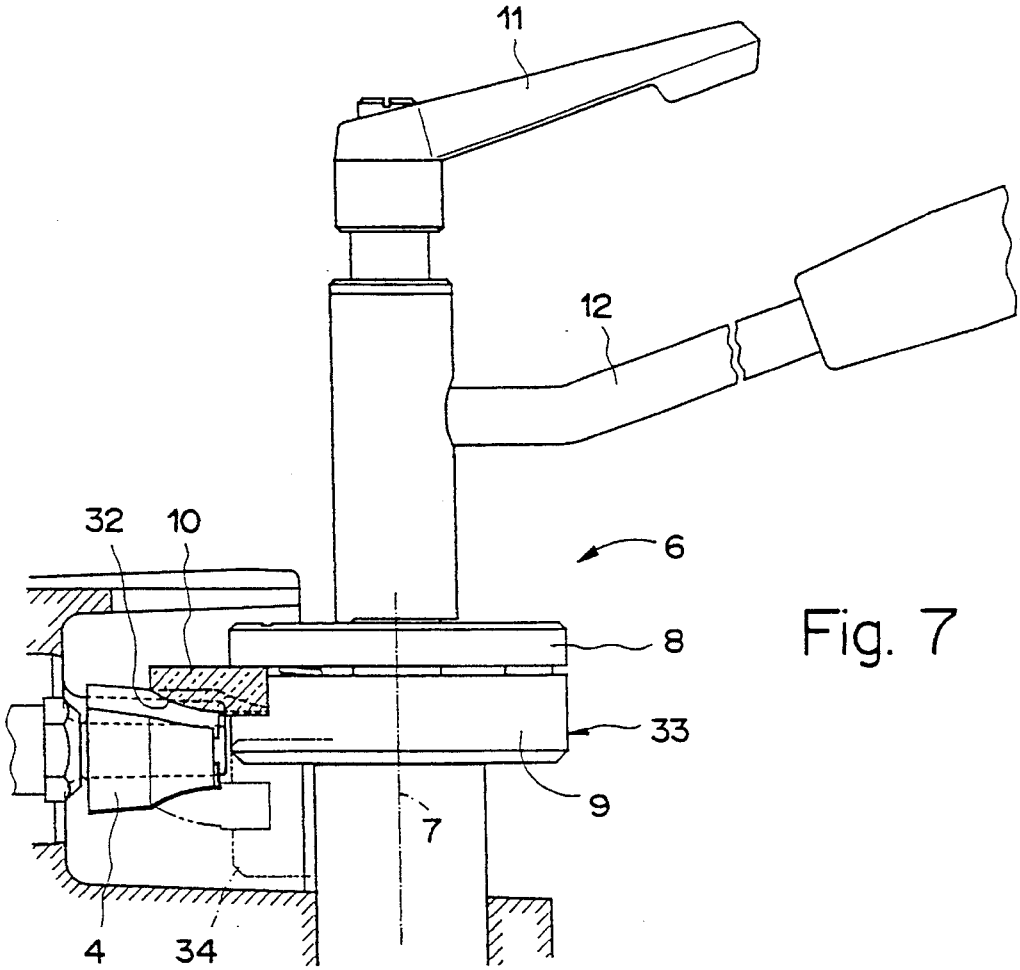
FIGS. 7 and 8 show schematically milling of the surface form into the remnant.

To make a patch 19, the clamping device 6 is brought into a first position, shown in FIG. 7 and designated by reference numeral 33, by means of pivoted lever 13 (FIG. 1), which is pursed downward by an operator (FIG. 6). The stop 22 hereby pushes against the stopping face 23 (FIG. 2). The pivoted lever 13 is held in this position by the operator. By means of the rotating lever 12, the remnant 10 is now led past the milling tool 4, the lateral surface 32 being milled into the remnant 10. After this milling step has been completed, the clamping device 6 is brought into a second position, indicated by a broken line in FIG. 7 and designated by the reference numeral 34, by means of pivoted lever 13, which is lifted by the operator (FIG.6). In this second position guiding pin 20 pushes against the set stop 21 (FIG. 2). By changing the setting of stop 21, the thickness of patch 19 can be altered. Afterwards, once again by turning the clamping device 6 with the rotating lever 12 about the axis of rotation 7, the clamped remnant 10' is led past the milling tool 4, and this time on the other side of the milling tool 4, so that the lateral surface 31 of remnant 10' can be milled. During this step, the pivoted lever 13 is kept by the operator constantly in the lifted position.

Figure 3:
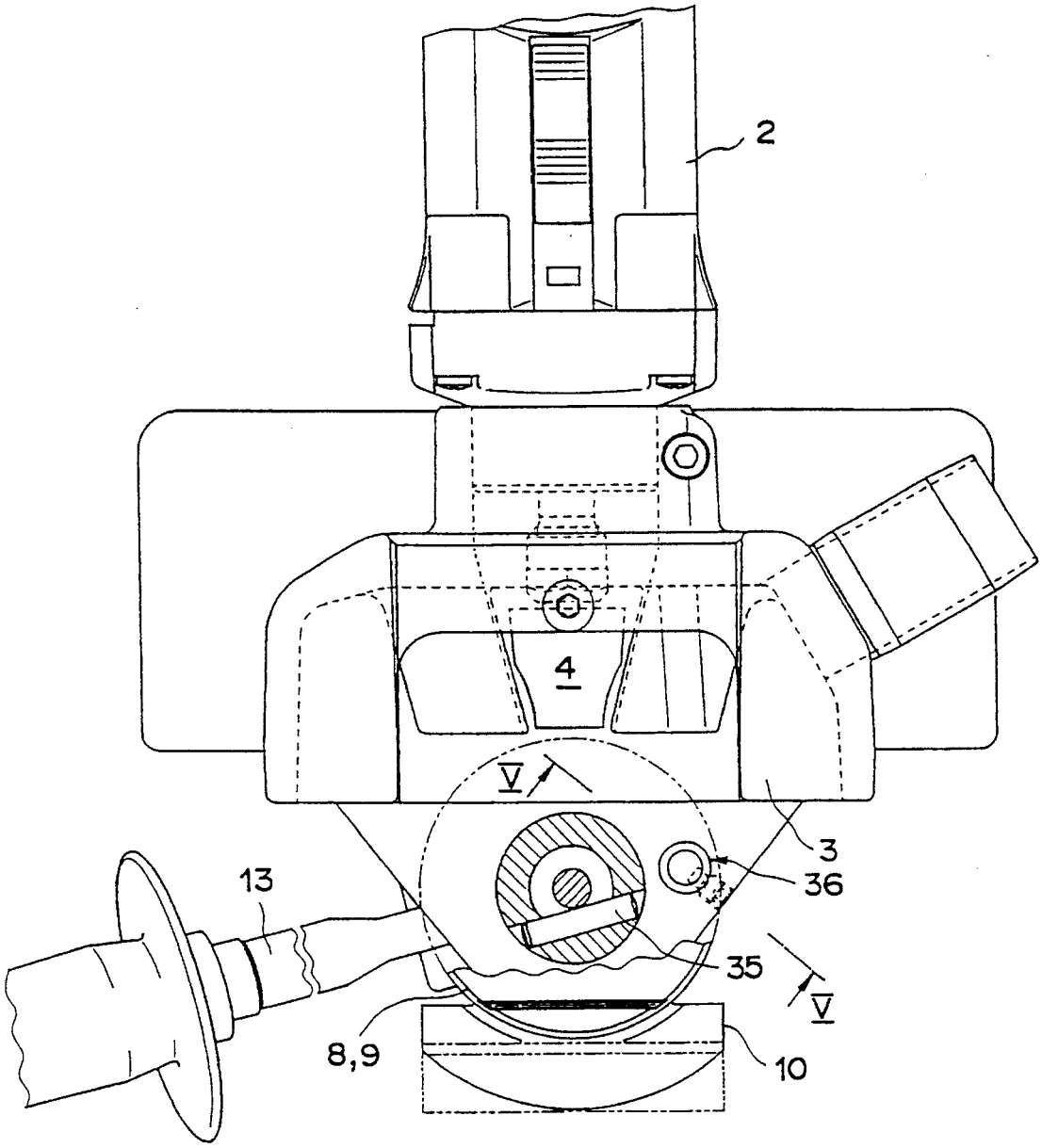
FIG. 3 is a top view, partially in section, of the device according to FIG. 2.

In the top view according to FIG. 3, the form of remnant 10 is indicated by unbroken lines at the point where it has undergone the two milling steps previously described. The outer edge of this remnant 10 has a circular form with a radius which corresponds essentially to the radius of the milling cutter of the hand milling apparatus with which the craftsman mills out the piece of wood to be patched.

Figure 5:
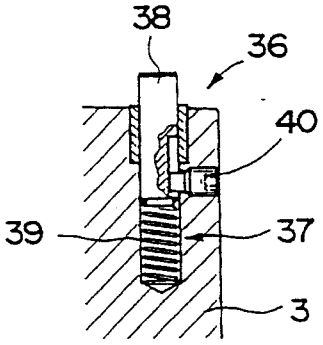
FIG. 5 is a section along the line V—V of FIG. 3.

The rotatability of the clamping device 6 with respect to the supporting frame 3 can be blocked in a predetermined position by means of a locking device 36. As can be seen from FIG. 3, and in detail from FIG. 5, the locking device 36 comprises a pin 38 inserted in a bore 37 put into the supporting frame 3. This pin is supported resiliently by a spring 39. A locking screw 40, which is screwed into supporting frame 3, and whose front end projects into a guiding groove of pin 38, prevents pin 38 from falling out. When the position of clamping device 6 shown in FIG. 3 has been reached, pin 38 penetrates into a corresponding opening of clamping plate 9, the rotatability being blocked. This blocked position is then attained when remnant 10, clamped in clamping device 6, is opposite milling tool 4. In this blocked position the clamping lever 11 can be easily actuated for clamping and unclamping the remnant, and moreover the step of cutting off the patch 19 from the remnant 10 by means of the cutting off means 15, 17, 18, can also be undertaken, as will be described later on. To release clamping device 6 from this blocked position, clamping device 6 is simply lifted by the pivoted lever.

Figure 4:
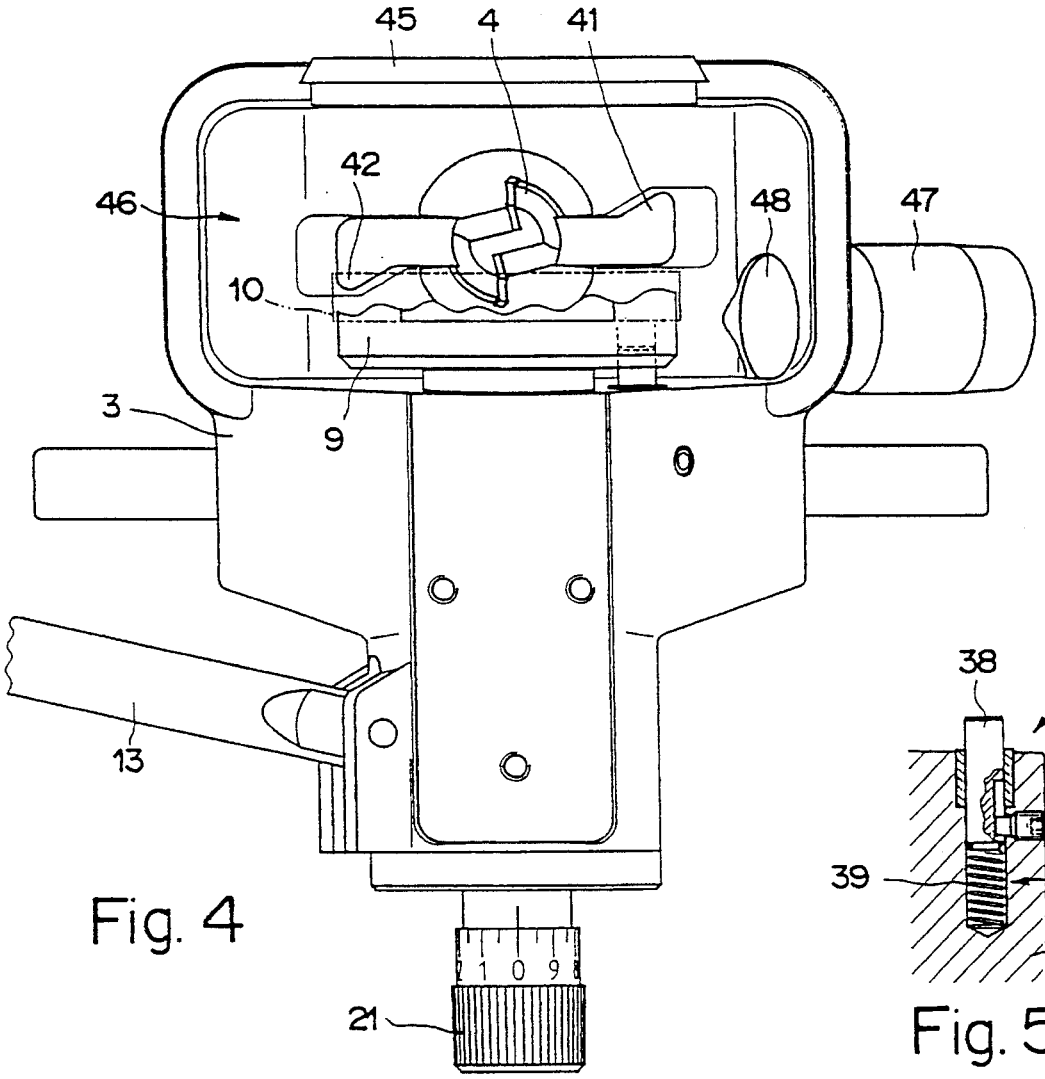
FIG. 4 is a frontal view of the inventive device according to FIGS. 2 and 3, the clamping device being partially omitted, for reasons of clarity.

As can be seen from FIG. 4, there is a lead 41 and 42, respectively, on each side of the milling tool 4, which lead is firmly connected in each case to the supporting frame 3. The remnant 4 to be milled, which is clamped in clamping device 6, should be led past the rotating milling tool 4 in such a way that each time the movement of passing runs counter to the direction of rotation of the milling tool 4. The two leads 41 and 42 have been provided to prevent milling of the remnant 10 in the same direction of movement. When remnant 10 has not yet been milled and has the shape of a parallelepiped, it can only be moved from the side of the lead 42 and above the same toward the milling tool 4, as shown in FIG. 4; starting from the other side, remnant 10 would only queue up at lead 41, whereby only movement in the counterdirection would be permitted. When lateral surface 32 is milled into remnant 10, the remnant can pass by lead 41. Milling of lateral surface 31 takes place inversely. Here remnant 10 must be led from the side of lead 41 and below the same to the milling tool because, coming from the other side, lead 42 would prevent this movement.

Figure 8:
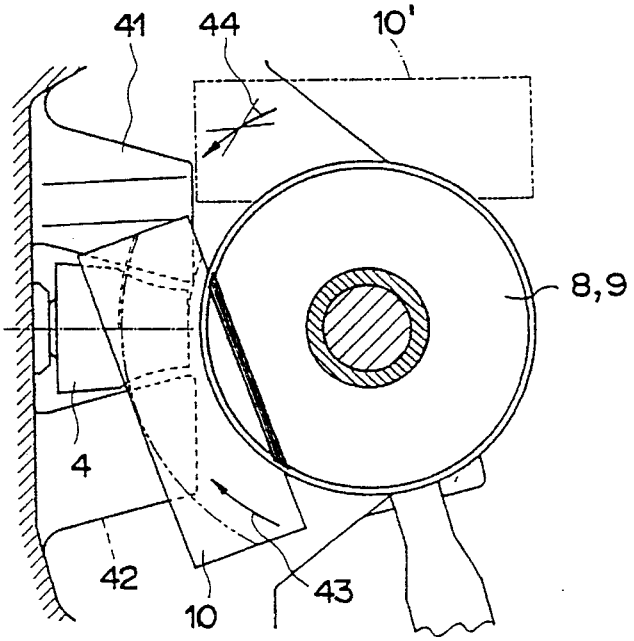

This aspect is also shown in FIG. 8. While the remnant held by clamping plates 8 and 9 can be led past the milling tool in the direction of arrow 43—since lead 41 is crossed first only after milling has been undertaken—the remnant 10', indicated by broken lines, would queue up with its corners on lead 41 if led past in the counter-direction, shown by the arrow of broken lines 44.

As can be seen from FIG. 4, the adjustable stop 21 can be provided with a scale in a known way by means of which the stop and thus the thickness of the patch 19 to be produced can be preset. Also seen in FIG. 4 is that milling tool 4 is accommodated in a space 46 formed by supporting frame 3 and a protective covering, the risk of injury to an operator of this device thus being excluded. In addition, a fitting 47 is disposed on supporting frame 3 which has an opening 48 that opens out into space 46, and to which a suction hose, not depicted, can be connected. The suction hose could be connected to a known suction device, not shown. Shavings generated during the milling process could thereby be suctioned away.

As can be seen from FIG. 6 the pivoted lever 13 is pivotable about an axis 14 fixed in supporting frame 3 for displacement of clamping device 6. One end of pivoted lever 13 is connected to guiding pin 20 of clamping device 6 while the other end of pivoted lever 13 forms a handle 52.

Figure 10:
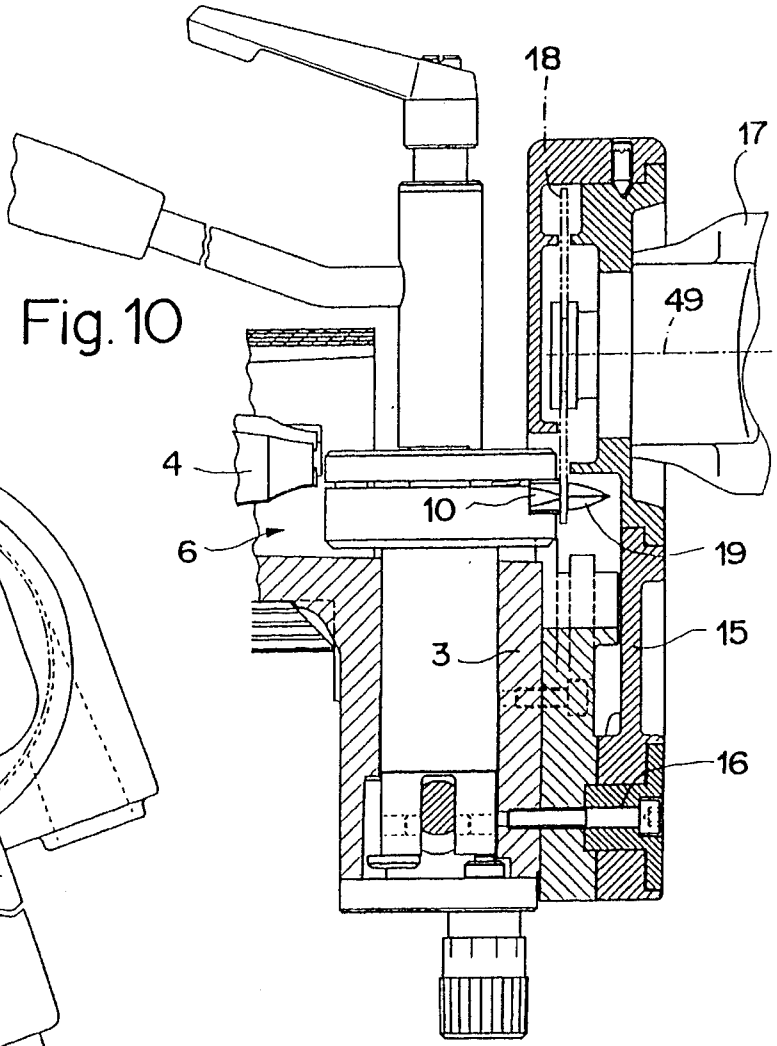
FIG. 10 is a partial section of the device according to the invention, the cutting off means being shown during the cutting off step.
Figure 9:
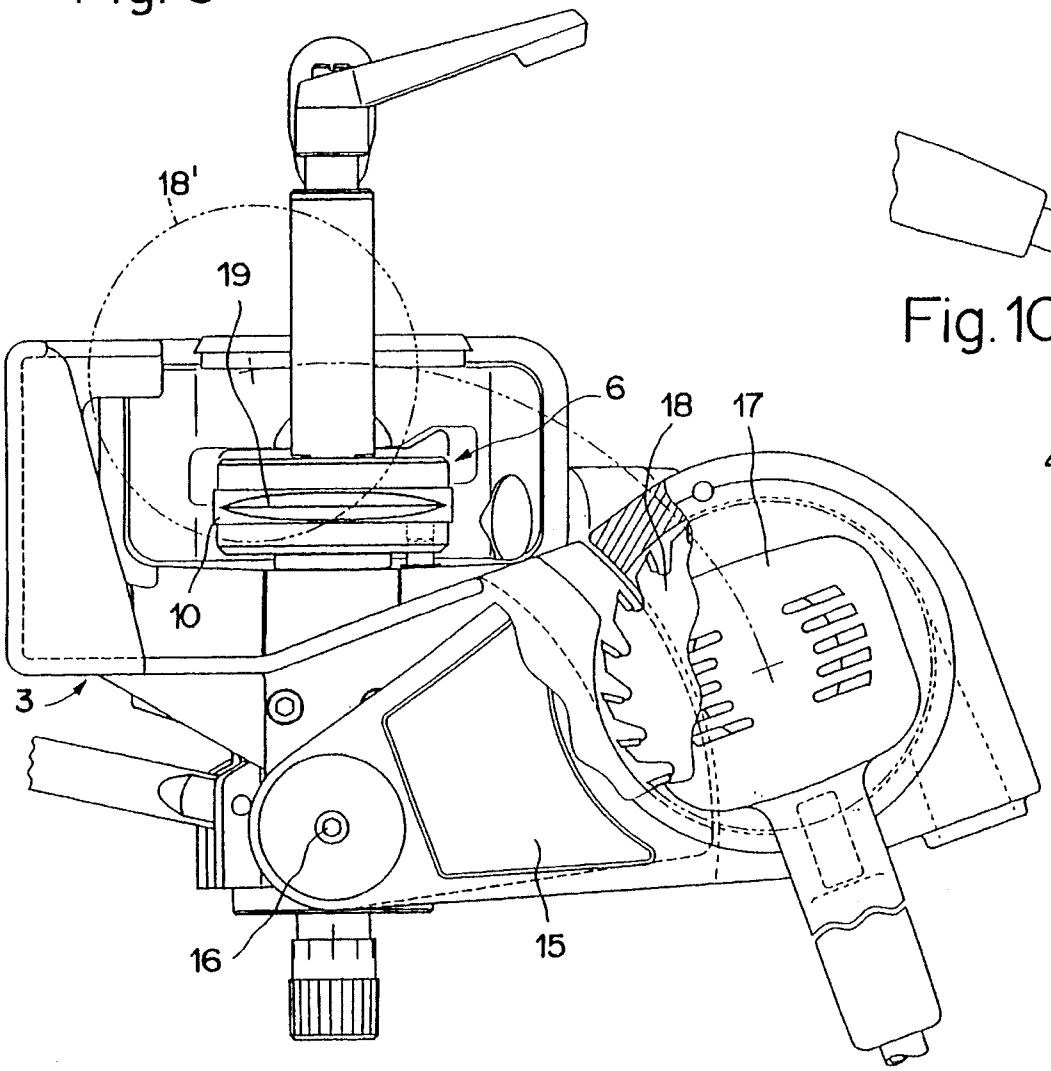
FIG. 9 is a frontal view of the device according to the invention with the cutting off means mounted.

The patchmaking device 1 has a cutting off means to separate patch 19 from remnant 10, shown in FIGS. 9 and 10. The swivelling bow 15 is pivotably mounted on supporting frame 3 about pivot axis 16.

The second driving unit 17 is mounted on swivelling bow 15 on the end thereof remote from pivoted lever 16. This second driving unit 17 drives circular saw 18 in rotation, which rotates about the saw blade axis 49.

During milling of the remnant 10, the cutting off means 15, 17, 18 is pivoted out of the area of the remnant, as can be seen from FIG. 9. This final position is limited by a stop, not shown. When the form of patch 19 has been completely milled into remnant 10, clamping device 6 is brought into the position in which pin 38 of locking device 36 locks clamping device 6. Then cutting off means 15, 17, 18 can pass in front of clamping device 6, as is shown in FIG. 9, until circular saw 18 assumes the position 18' indicated by a broken line. During this pivot step, the rotating disk of circular saw 18 separates patch 19 from remnant 10, held in clamping device 6, as can be seen especially in FIG. 10. This patch 19 can be inserted in a known way in the piece of wood to be patched which has been correspondingly milled, the fit being ensured, and the patch, after planing, being practically no longer visible, owing to the conformity of color and graining. After patch 19 has been separated, remnant 10 can be removed from the clamping device 6, after which production of another patch can take place.

Supporting frame 3 can easily be mounted on a base 50 (FIGS. 1 and 2), which base 50 can be provided in a known way with a screwing device with which the patchmaking device 1 can be fixed to a table.

Using this patchmaking device 1, the craftsman can produce patches 19 at his work location made from a remnant 10 that he can cut off of the piece of wood to be patched. This is facilitated by the compact construction of this device, its minimal dimensions and its weight corresponding to a common portable hand-held appliance.

What is claimed is:

1. A device for making patches of the type used for patching resin galls on pieces of wood, the device comprising:

a milling tool defining a milling axis;

a support frame having a driving unit for holding the milling tool rotatably driveable about the milling axis;

a clamping device disposed on the support frame for holding a workpiece;

means for rotating the clamping device about a rotational axis perpendicular to the milling axis;

means for shifting the clamping device along the rotational axis between a first position, where the workpiece is led past the milling tool a first time by means of rotation of the clamping device about the rotational axis, and a second position, where the workpiece is led a second time past the milling tool by means of rotation of the clamping device about the rotational axis; and a cutter for separating a patch from the workpiece.

2. The device of claim 1 wherein the milling tool defining a circumference and having a plurality of cutting elements disposed about the circumference, the cutting elements having a contour corresponding to a desired lateral surface of the patch.

3. The device of claim 1 further comprising one or more stops for fixing the first and second positions, at least one of the stops being adjustable, the shifting means comprising a shaft in the support frame and a lever pivotable mounted about the shaft, the lever having a first end coupled to the clamping device and a second end forming a handle.

4. The device of claim 1 wherein the rotating means comprises a lever joined rigidly to the clamping device and a releasable locking means for fixing the lever to at least one rotational position.

5. The device of claim 2 wherein the milling tool rotates in a first direction about the milling axis, the rotating means rotating the workpiece about the rotational axis such that the lateral surface of the workpiece moves in a second direction counter to the first direction of the milling tool.

6. The device of claim 1 further comprising a clampable holder for releasably fixing the support frame to a level surface.

7. The device of claim 1 further comprising a protective hood surrounding the milling tool and defining a space therebetween and a fitting on the support frame adapted for coupling to a suction hose for removal of chips within the space.

8. The device of claim 4 wherein the cutter comprises a circular saw, a second driving unit for rotatable driving the circular saw and a swivelling bow fixed to the circular saw and pivotally coupled to the support frame for pivotally moving the circular saw past the clamping device such that the patch is cut from the workpiece.

9. The device of claim 8 wherein the releasable locking means locks the clamping device in said at least one rotational position while the circular saw cuts the patch from the workpiece.

* * * * *